US005529193A

United States Patent [19]

Hytönen

[11] Patent Number: 5,529,193

[45] Date of Patent: Jun. 25, 1996

[54] CRANE CONTROL METHOD

[76] Inventor: Kimmo Hytönen, Ristiaallokonkatu 6 B 38, FIN-02320 Espoo, Finland

[21] Appl. No.: 408,373

[22] Filed: Mar. 22, 1995

Related U.S. Application Data

[63] Continuation of Ser. No. 129,109, filed as PCT/FI92/00111, Apr. 10, 1992, published as WO92/18416, Oct. 29, 1992, abandoned.

[30] Foreign Application Priority Data

Apr. 11, 1991 [FI] Finland ..... 911757

[51] Int. Cl.[6] ..... B66C 13/06

[52] U.S. Cl. ..... 212/275

[58] Field of Search ..... 212/147, 132, 212/161, 275; 180/179; 246/187 A; 901/9

[56] References Cited

U.S. PATENT DOCUMENTS

| | | | |
|---|---|---|---|
| 3,517,830 | 6/1970 | Virkkala . | |
| 3,921,818 | 11/1975 | Yamagishi | 212/132 |
| 4,066,874 | 1/1978 | Shaw | 180/179 |
| 4,341,985 | 7/1982 | Houskamp | 180/179 |
| 4,506,642 | 3/1985 | Pfalzgraf et al. | 180/179 |
| 4,520,778 | 6/1985 | Nanjo et al. | 180/179 |
| 4,958,288 | 9/1990 | Takahashi | 180/179 |
| 4,997,095 | 3/1991 | Jones et al. | 212/161 |
| 5,117,992 | 6/1992 | Simkus et al. | 212/147 |

FOREIGN PATENT DOCUMENTS

| | | |
|---|---|---|
| 3513007C2 | 6/1989 | Germany . |
| 1132967 | 11/1968 | United Kingdom . |
| 1391245 | 6/1973 | United Kingdom . |

OTHER PUBLICATIONS

Derwent's Abstract, No. 84–61 publ. week 8410.

*Primary Examiner*—David A. Bucci
*Assistant Examiner*—Thomas J. Brahan
*Attorney, Agent, or Firm*—McGlew and Tuttle

[57] ABSTRACT

A method of controlling a crane includes comparing a new velocity request to a previous velocity request and forming acceleration sequences based on each comparison. The acceleration sequences are stored. Charges in velocity based on the stored acceleration sequences are added for each given time wherein the sum of velocity changes is added to the previous velocity request to form a new control command.

3 Claims, 3 Drawing Sheets

CRANE CONTROL METHOD

This is a file wrapper continuation application of application Ser. No. 08/129,109 filed as PCT/FI92/00111, Apr. 10, 1992, published as WO92/18416, Oct. 29, 1992 now abandoned.

FIELD OF THE INVENTION

The invention relates to a method of controlling a crane or a similar apparatus, utilized e.g. in controlling an overhead crane, wherein the attendant of the crane applies velocity requests from the control system of the crane to the operating means of the crane as control sequences, and the velocity requests applied by the attendant are read into the control system.

BACKGROUND OF THE INVENTION

A crane is a generally used apparatus for handling parcelled goods under such conditions where the parcel to be handled cannot be transferred along the floor or ground. Cranes are used, for example, in ports and stores as well as in industry for moving parcels. The principle underlying both the structure of the cranes based on open-loop control, i.e. cranes without feedback, and the methods of controlling them is that a time of oscillation of the mathematical pendulum is calculated on the basis of the known centre of gravity and suspension height of the load suspended from the crane. Control methods based on the mathematical pendulum are relatively simple and useful in practical solutions.

In controlling the crane and moving the load undesired oscillation of the load occurs, disturbing the use and operativeness of the crane. It is previously known to use accelerating and decelerating sequences minimizing the oscillation of the load to move the load hanging from the crane. E.g. Finnish Patent 44,036 (U.S. Pat. No. 3,921,818) discloses an apparatus minimizing the oscillation of the load, the apparatus setting a corresponding change in acceleration to follow each change in the acceleration of the control sequence after half the time of oscillation.

SUMMARY AND OBJECTS OF THE INVENTION

The problem with the known solutions is that in them similar fragments of a control sequence added to one another at a certain moment are executed consecutively; and on the other hand, the known solutions require that the previous control sequence should be completed before beginning another control sequence. In the most general control movements of the crane, the execution of the control sequence takes about 4 to 10 seconds, wherefore the known solutions are not very useful in assisting the crane-man. The object of the invention is to provide a control method that eliminates the disadvantages inherent in the prior art and the known solutions. This is achieved by the method of the invention, which is characterized in that the velocity request is compared to the previous velocity request; if the velocity request has changed, an accelerating sequence for the corresponding change in velocity is provided, subsequently storing the resultant accelerating sequence, whereafter, or if the velocity request remains unchanged, the changes in velocity determined by the stored accelerating sequences at a given time are added up and this sum is added to the previous velocity request, the resultant sum providing a new velocity request, which is set as a new control command and velocity request for the operating means of the crane.

The method of the invention is based on the idea that the features of the control system of the crane are improved by adding up, in a defined manner, different control sequences eliminating the oscillation of the load after acceleration.

Significant advantages are achieved by the method according to the invention for controlling the crane, the most significant advantage being an improvement in the features of the control system assisting the crane-man. When the method of the invention is used, the desired final velocity aimed at by acceleration can be randomly modified at any moment, also during the actual accelerating and decelerating sequences. Thereby a new desired final velocity is achieved without undesired after-oscillation of the load. In practice also such situations occur where the control system, for one reason or another, sends a false control command, where by the crane is accelerated toward a new final velocity owing to the method of the invention the effect of such false commands on the use of the crane and the oscillation of the load can be effectively eliminated.

BRIEF DESCRIPTION OF THE DRAWINGS

In the following the invention is described in greater detail with reference to the attached drawings, wherein.

DETAILED DESCRIPTION OF THE PREFERRED EMBODIMENT

Figure 1:
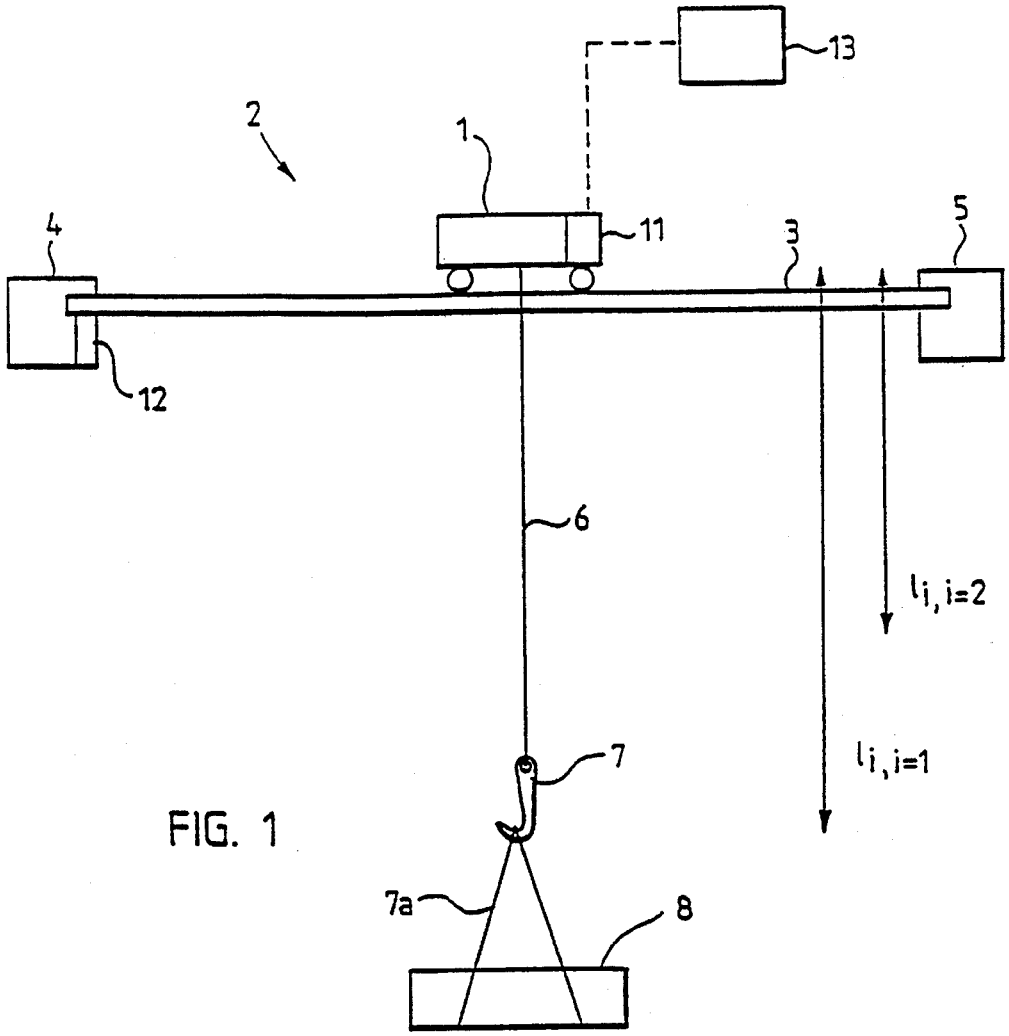
FIG. 1 shows a schematic view of an overhead crane.

According to FIG. 1, a trolley 1 of a crane is arranged to be movable along a bridge beam 3 of an overhead crane 2. The bridge beam 3 is further arranged to be movable in relation to end beams 4 and 5 at the ends of the bridge beam 3. From the trolley 1 of the overhead crane 2 is suspended a cable, rope or other suitable suspension means 6 having a hook 7 or other corresponding means at the end thereof. A load 8 is placed in the hook 7 by means of elevating belts *7a*. An elevation height $\mathbf{1}_i$ of the load is regarded as being calculated from the location of the hook 7. Each varying elevation height $\mathbf{1}_i$ of the load 8 (i=1,2, . . . ) corresponds to a time T of oscillation characteristic of each elevation height $\mathbf{1}_i$, whereby the time T of oscillation of the system is as determined by Formula (1)

$$T=2\pi(1_i/g)^{1/2} \quad (1)$$

wherein g= acceleration of gravity.

Figure 2:
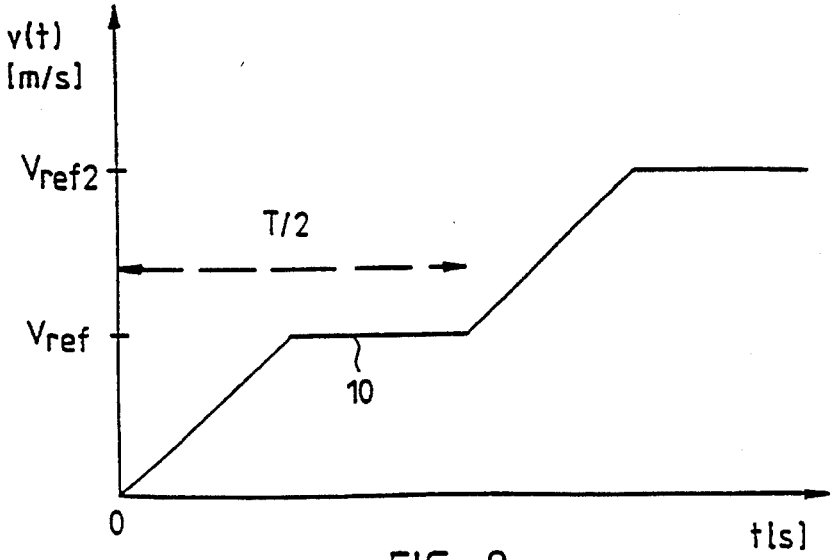
FIG. 2 illustrates a velocity sequence functioning as a control sequence.

The crane 2 is controlled by a control system 13 of the crane by means of different control sequences 10, one of the sequences being shown in FIG. 2. The control sequence 10 illustrated in FIG. 2 is a velocity sequence v(t) presented as a function of time t. The control sequence 10 is directed to control operating means 11 of the trolley 1 and operating means 12 of the bridge beam 3 carrying the trolley 1. For example, electromotors can function as the operating means 11 and 2.

Figure 3:
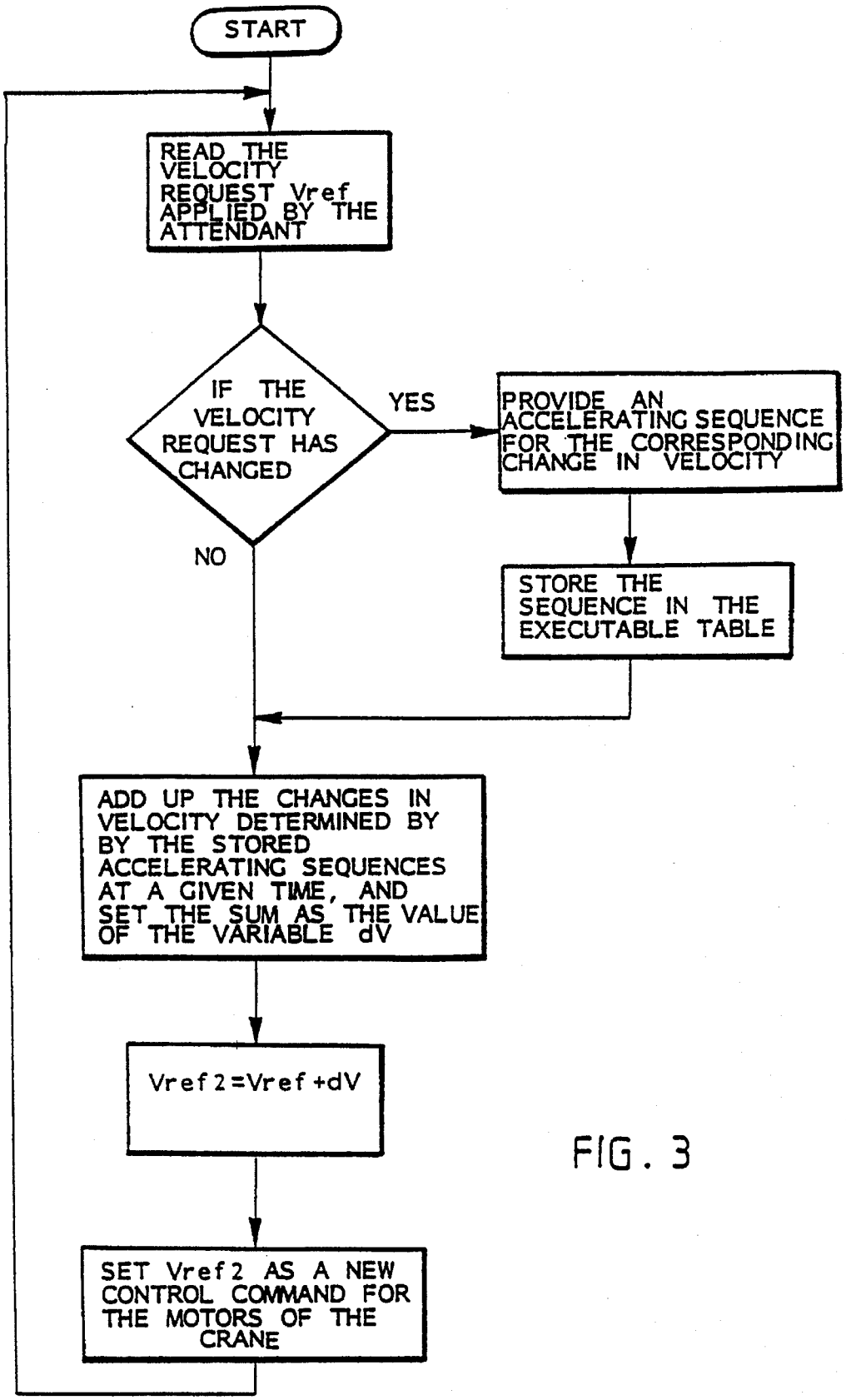
FIG. 3 shows a flow chart of the method according to the invention.
Figure 4:
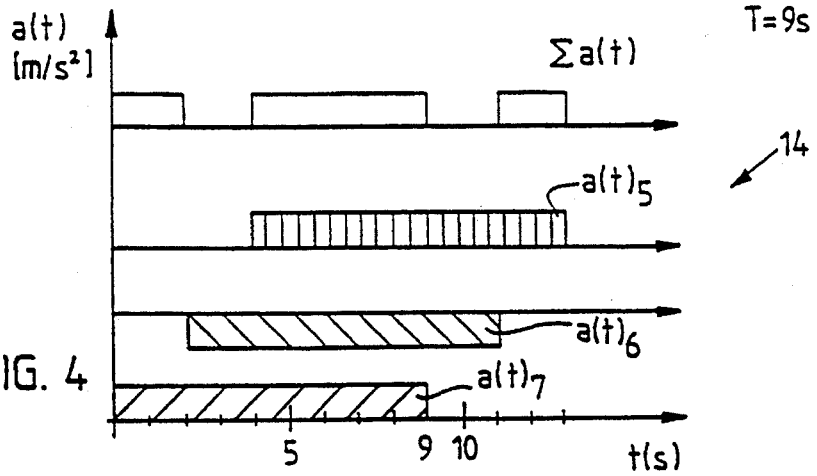
FIG. 4 shows the executable table of a pre- ferred embodiment of the invention.

FIG. 3 shows a flow chart describing a method of the invention for controlling the crane 2 or a similar apparatus, utilized e.g. in controlling different cranes, such as an overhead crane 2, a multi-function crane or a swinging crane, wherein the attendant of the crane 2 transferring the load 8 applies velocity requests Vref from a control system 13 of the crane to the operating means 11 and 12 of the crane as control sequences 10. The velocity requests Vref applied by the attendant to the operating means via the control system 13 are read into the control system 13, subsequently comparing the latest velocity request Vref to the previous velocity request; if the velocity request has changed, an accelerating sequence for the corresponding change in velocity is provided, whereafter the resultant accelerating sequence is stored e.g. in a executable table or the like included in the control system 13. FIG. 4 illustrates storage of the accelerating sequences $a(t)_{5-7}$ and the sum $\Sigma$ a(t) of the accelerating sequences added up. In FIG. 4, the time T of oscillation of the load is 9 seconds long. The sum $\Sigma$ a(t) of the accelerating sequences determines the magnitude of a velocity request Vref2 directed to the operating means 11, 12 of the crane 2. According to FIG. 3, in the following step, or if the velocity request remains the same, the changes in velocity determined by the stored accelerating sequences a(t) at a given time are added up and this sum dV is added to the previous velocity request Vref, the resultant sum providing a new velocity request Vref2, which is set as a new control command and velocity request Vref2 for the motors or corresponding means functioning as the operating means 11, 12 of the crane. The velocity request Vref2 is set as a control command either for the operating means 11 arranged to move the trolley 1 or for the operating means 12 arranged to move the bridge beam 3 carrying the trolley 1 or for both said operating means depending on what kind of control command the attendant of the crane 2 applies to the control system 13.

In a preferred embodiment of the invention the accelerating sequences a(t) are stored in a special executable table 14 or the like as illustrated in FIG. 4. The accelerating sequences $a(t)_{5-7}$ corresponding to the detected changes in velocity are stored in the executable table 14. Several accelerating sequences are stored in the executable table 14. The executable table 14 is gone through and the changes in velocity determined by the stored accelerating sequences a(t) at a given time are added up therefrom, whereby the sum of the changes in velocity at a given time t is dV.

According to a preferred embodiment of the invention a new velocity request Vref2 is set as a new velocity instruction for the operating means 11, 12 of the crane practically immediately after providing the new velocity request Vref2, the control system 13 applying a new velocity request Vref2 to the crane 2 before completing the control sequence according to the previous velocity request Vref.

Figure 5:
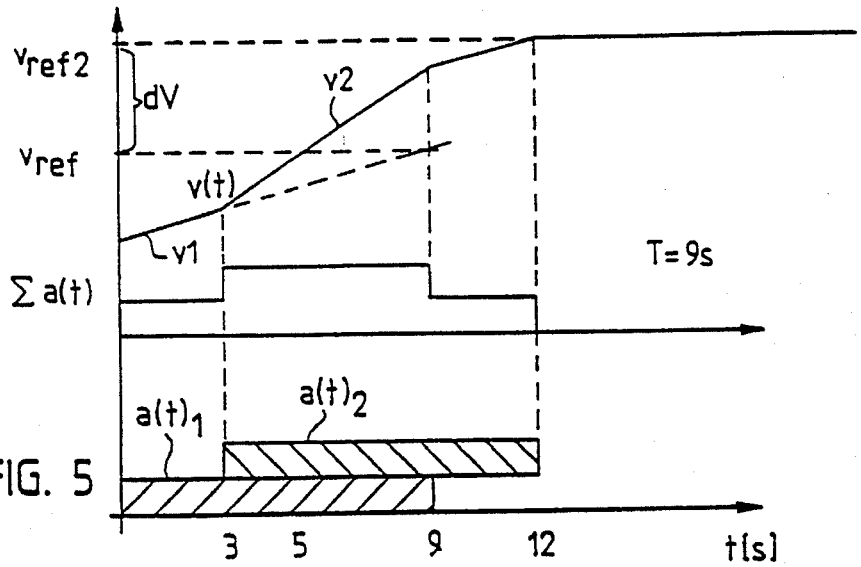
FIG. 5 illustrates the adding up of the accelerating sequences, and the velocity sequence deter- mined by the sum.

FIG. 5 illustrates addition of two accelerating sequences $a(t)_1$ and $a(t)_2$, the sum being $\Sigma$ a(t). FIG. 5 also shows a velocity sequence v(t) determined by the accelerating sequences. FIG. 5 illustrates a situation where the load is accelerated on two velocity ramps v1 and v2. This can be understood such that at t=0 the crane attendant applies the velocity that the velocity request Vref according to the velocity ramp v1 would results in. Proceeding along the velocity ramp v2, the velocity request is doubled by the crane attendant at t=3 seconds. Both changes in velocity are executed at a similar constant accelerating pulse $a(t)_{1-2}$, the time of oscillation of the mathematical pendulum being T=9 seconds. When the accelerating pulse or the accelerating sequence $a(t)_1$ is completed at t=9 seconds, the proceeding again continues on the ramp in the direction of the velocity ramp v1 and continues parallel thereto until also the accelerating pulse or the accelerating sequence $a(t)_2$ is completed. FIG. 5 also illustrates providing of the velocity request Vref2 from the original velocity request Vref and the sum dV of the changes in velocity. The acceleration results in the target velocity Vref2 without oscillation of the load and without any necessity of first completing the previous control sequence.

Figure 6:
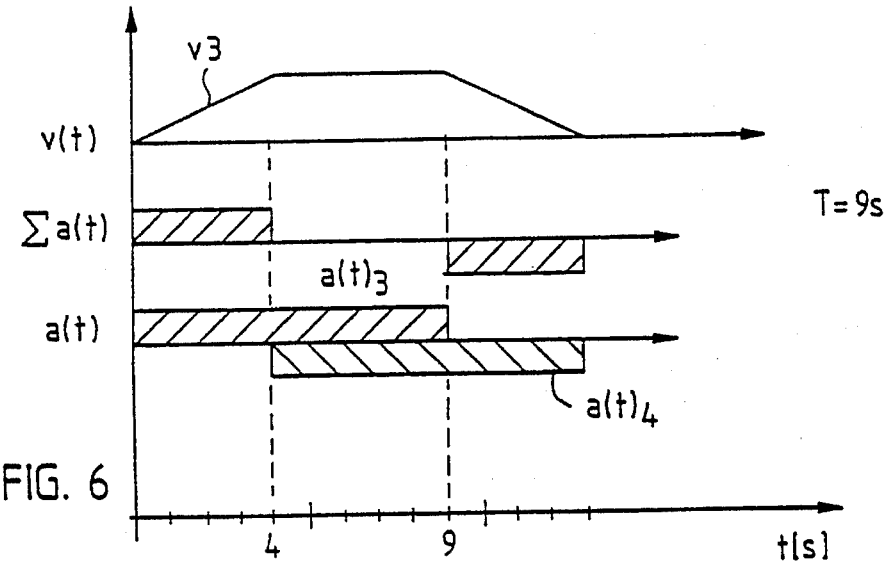
FIG. 6 illustrates the sum of two divergent accelerating sequences, and the velocity sequence determined by the sum.

FIG. 6 illustrates addition of two divergent accelerating sequences $a(t)_3$ and $a(t)_4$, the sum being $\Sigma$ a(t). FIG. 6 also shows the velocity sequence v(t) determined by the accelerating sequences a(t). This can be understood such that at t=0 the crane attendant applies the velocity that the velocity request according to the velocity ramp v3 would result in. At t=4 seconds, the crane attendant changes the target velocity to v(t)=0, i.e. the attendant wants to stop the crane. As above, also here both changes in velocity are executed at a similar constant accelerating pulse $a(t)_{3-4}$, the time of oscillation of the mathematical pendulum being T=9 seconds. The acceleration results in the target velocity 0 without oscillation of the load and without any necessity of first completing the previous control sequence.

Above, the term acceleration should be understood as both positive and negative acceleration, i.e. both as conventional acceleration and as deceleration with the opposite effect.

To carry out the method presented in the flow chart 3, the control unit 13 should comprise a means for applying a control command, a means for reading the control command, a means for comparing the new control command with the previous control command, a means for providing an accelerating sequence, a means, such as an executable table, for storing accelerating sequences, a means for adding up the accelerating sequences and a means for providing a new control command and for apply- ing the control command to the crane. A flow chart of a practical apparatus solution (not shown) would correspond, in outline, to the structure of the flow chart of FIG. 3. The solutions in question can be carried out e.g. by programmable logic.

Although the invention has been described above with reference to the examples illustrated in the drawings, it should be understood that the invention is not limited thereto but that it can be modified in many ways within the limits of the inventive idea presented in the enclosed claims.

I claim:

1. A method of controlling the movement of an overhead crane via an operating element, the crane supporting a suspended element and including means for raising and lowering the suspended element, the method comprising the steps of:

applying velocity requests from a control system in the form of control sequences to the operating means whereby velocity requests applied are read into the control system;

applying subsequent velocity requests;

comparing each subsequent velocity request to an earlier velocity request to determine a change in velocity;

for each change in velocity determined, generating an acceleration sequence based on the determined change in velocity and storing each generated acceleration sequence;

determining a change in velocity based on the stored acceleration sequences at each given time to form a change in velocity sum;

adding said change in velocity sum to a previous velocity request to form a resultant velocity sum and assigning said resultant velocity sum as a new velocity request forming a new control command and applying the new control command to the operating element of the crane.

2. A method according to claim 1, wherein said acceleration sequences are stored in an executable table, said charges in velocity determined by said acceleration sequences being added up from said executable table.

3. A method of controlling the horizontal movement of an overhead crane, the crane having an operating element for moving in a first horizontal direction and a second orthogonal horizontal direction, the method comprising the steps of:

applying velocity requests from a control system in the form of control sequences to the operating means whereby velocity requests applied are read into the control system;

applying subsequent velocity requests;

comparing each subsequent velocity request to an earlier velocity request to determine a change in velocity;

for each change in velocity determined, generating an acceleration sequence based on the determined change in velocity and storing each generated acceleration sequence;

determining a change in velocity based on the stored acceleration sequences at each given time to form a change in velocity sum;

adding said change in velocity sum to a previous velocity request to form a resultant velocity sum and assigning said resultant velocity sum as a new velocity request forming a new control command and applying the new control command to the operating element of the crane before completion of a control sequence of a previous velocity request.

* * * * *